United States Patent [19]

Jones

[11] 4,140,551

[45] Feb. 20, 1979

[54] LOW TEMPERATURE MICROCRYSTALLINE ZINC PHOSPHATE COATINGS, COMPOSITIONS, AND PROCESSES FOR USING AND PREPARING THE SAME

[75] Inventor: William C. Jones, Enfield, Conn.

[73] Assignee: Heatbath Corporation, Springfield, Mass.

[21] Appl. No.: 826,195

[22] Filed: Aug. 19, 1977

[51] Int. Cl.[2] ..... C23F 7/10

[52] U.S. Cl. ..... 148/6.15 Z; 148/31.5

[58] Field of Search ..... 148/6.15 Z

[56] References Cited

U.S. PATENT DOCUMENTS

| | | | |
|---|---|---|---|
| 2,975,082 | 3/1961 | Henricks | 148/6.15 Z |
| 3,161,549 | 12/1964 | Kallenbach | 148/6.15 Z |
| 3,307,979 | 3/1967 | Upham | 148/6.15 Z |
| 3,520,737 | 7/1970 | Gerassimoff et al. | 148/6.15 Z |
| 3,676,224 | 7/1972 | Snee | 148/6.15 Z |
| 3,681,148 | 8/1972 | Nagenknecht et al. | 148/6.15 Z |

FOREIGN PATENT DOCUMENTS

| | | | |
|---|---|---|---|
| 1368845 | 10/1974 | United Kingdom | 148/6.15 Z |

*Primary Examiner*—Ralph S. Kendall
*Attorney, Agent, or Firm*—Morgan, Finnegan, Pine, Foley & Lee

[57] ABSTRACT

Microcrystalline zinc phosphate coatings and compositions for their formation are provided, which can be applied to metals at low temperatures, the coating compositions containing as principal ingredients a specific balance of calcium and zinc together with phosphates, nitrates, and nitrites. Processes for preparing and using the coating compositions are also provided.

81 Claims, 1 Drawing Figure

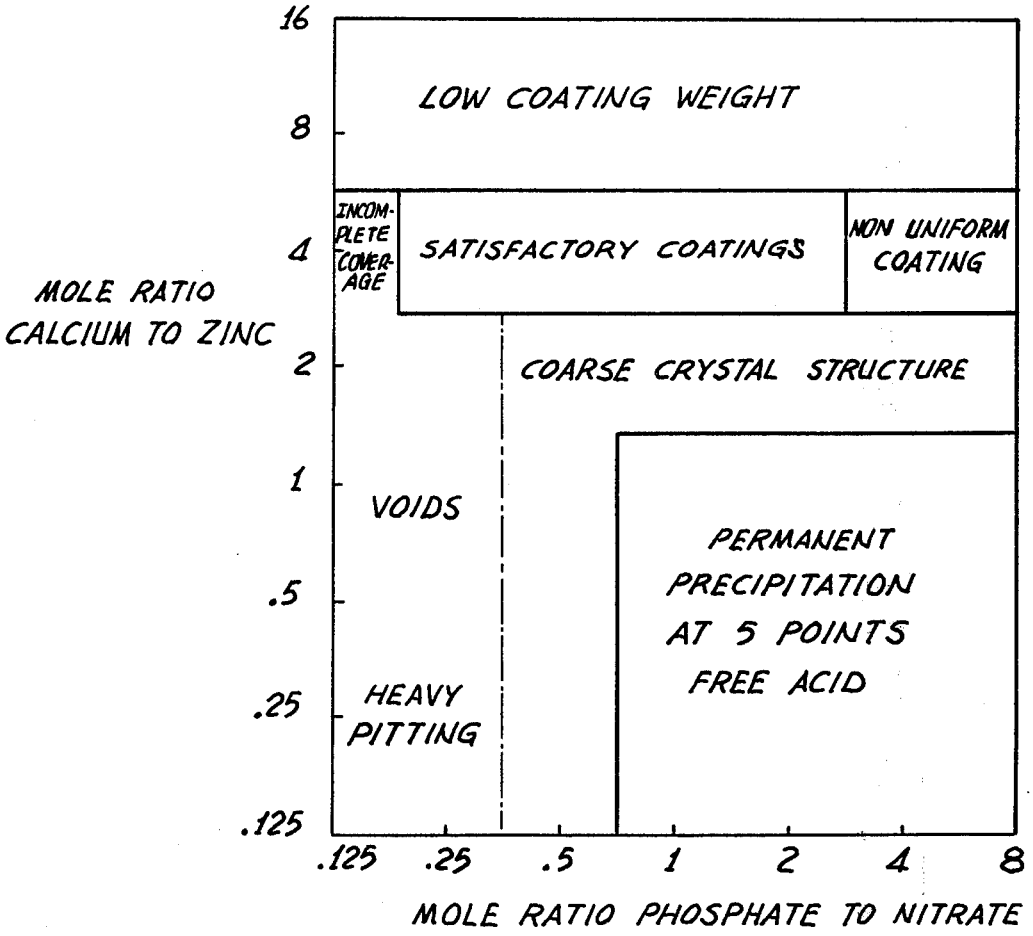
16
8
4
2
1
.5
.25
.125
MOLE RATIO
CALCIUM TO ZINC
LOW COATING WEIGHT
INCOM-
PLETE
COVER-
AGE
SATISFACTORY COATINGS
NON UNIFORM
COATING
COARSE CRYSTAL STRUCTURE
VOIDS
HEAVY
PITTING
PERMANENT
PRECIPITATION
AT 5 POINTS
FREE ACID
.125
.25
.5
1
2
4
8
MOLE RATIO PHOSPHATE TO NITRATE

LOW TEMPERATURE MICROCRYSTALLINE ZINC PHOSPHATE COATINGS, COMPOSITIONS, AND PROCESSES FOR USING AND PREPARING THE SAME

BACKGROUND OF THE INVENTION

This invention relates to phosphate coatings of metals and more particularly to microcrystalline zinc phosphate coating baths and processes for preparing and using the same.

It is well known in the metal finishing art to provide metal surfaces, particularly ferrous metal surfaces, with an inorganic phosphate coating by contacting the surface with an aqueous phosphating solution. The phosphate coating generally protects the metal surface against corrosion and serves as an excellent base for the subsequent application of organic coatings, such as paint, lacquer, varnish, primers, synthetic resins, elastomers, enamels, oils, drawing compounds, lubricants, and the like.

In the past, in order to obtain satisfactory coatings, it has been necessary to employ and maintain the coating baths at high temperatures, e.g., in the order of about 160° F. to 200° F. In doing so, large amounts of energy are consumed. Typical of coating baths which need to be employed at high temperatures are those disclosed, for example, in U.S. Pat. Nos. 3,090,709 and 3,676,224.

In view of the present high costs of energy and the need to conserve energy, it has become desirable to provide phosphate coating baths for metals which can be used at low temperatures, thereby reducing the amount of energy consumed in the process, but which still provide excellent corrosion resistant coatings and coatings which are excellent bases for subsequent painting, and the like.

SUMMARY OF THE INVENTION

Accordingly, it is one object of the present invention to provide a microcrystalline zinc phosphate coating composition which is suitable for producing phosphate coatings on metal surfaces at low temperatures.

Another object of this invention is to provide a microcrystalline zinc phosphate coating composition which is suitable for producing complete, smooth and uniform coatings on metals at low temperatures.

A further object of the present invention is to provide a novel process for applying a microcrystalline phosphate coating on metals at low temperatures.

A still further object of this invention is to provide a process for applying a phosphate coating on metals at low temperatures which is less costly than high temperature processes produced heretofore.

Still another object of the present invention is to provide a process for applying a phosphate coating on metals at low temperatures which will utilize the reacting chemicals with equal or greater efficiency than that achieved with the high temperature process.

Yet another object of the present invention is to provide a metal object with a coating whose weight and performance characteristics are equal to or better than those achieved by prior high temperature art.

Still another object of this invention is to provide a metal article having a smooth and uniform microcrystalline zinc phosphate coating produced at low temperature.

A further object of this invention is to provide a phosphate coating process to produce microcrystalline coatings at low temperature that do not require ingredients or materials other than those that are now normally encountered in conventional high temperature processes.

Still another object of this invention is to provide a process that operates at low temperatures, thereby reducing the danger of exposure of the worker to elevated temperatures and the attendant fumes, vapors, and other hazards.

These and other objects are achieved herein by providing a microcrystalline zinc phosphate aqueous coating composition, useful at temperatures between about 70° F. and 120° F., comprising calcium ion, zinc ion, phosphate ion, nitrate ion and nitrite ion, wherein the sum of the total calcium and zinc concentration is at least about 0.2 molar, the total calcium to zinc molar ratio is from about 2.8 to 1 to about 5.8 to 1, respectively, the total phosphate to nitrate molar ratio is from about 0.18 to 1 to about 2.8 to 1, respectively, the concentration of nitrite, as $NO_2^-$, is from about 0.13 to about 0.33 grams per liter of coating composition, and the ratio of total acid to free acid is from about 8 to 1 to about 40 to 1.

BRIEF DESCRIPTION OF THE DRAWING

The sole FIGURE is a graphical representation showing the mole ratios of calcium to zinc and phosphate to nitrate used in the coating compositions and processes of this invention in order to prepare satisfactory coatings and the effects of operating outside these mole ratios.

DETAILED DESCRIPTION OF THE INVENTION

The formation of a phosphate coating on a metallic surface is an example of a conversion coating process. The surface being treated participates in the reaction and the coating produced may contain reaction products of the metal surface being treated. A stock loss must be generated, that is, metal must be consumed in order to form the coating. The dissolution and, therefore, oxidation of the metal to its ionic form can be considered to be a corrosion phenomenon that is electrochemical in its nature. Discrete areas on the surface assume anodic and cathodic properties. Metal is oxidized at the anodic sites according to the equation $Fe \rightarrow Fe^{+2} + 2e$ and a rise in pH occurs at the cathodic sites due to the reduction of hydrogen ion concentration $2H^+ + 2e \rightarrow H_2$. This rise in pH causes the metals in solution to precipitate as their phosphates at the cathodic sites. As the insoluble phosphates are precipitated at the cathodic sites, these sites become effectively blocked and further precipitation of additional phosphate is forced into new cathodic areas. Thus the ratio of cathodic to anodic sites decreases as the coating forms and the formation of the phosphate coating ceases when all of the cathodic sites have been covered.

The rate of coating formation can be accelerated by increasing the ratio of cathodic to anodic sites. This is frequently accomplished in industrial practice by the limited use of nitrite. The use of nitrite as a corrosion inhibitor for steel is well known and it is believed that the nitrite in a phosphating solution functions by inhibiting or blocking anodic sites, thereby increasing the ratio of cathodic to anodic sites. It has been surprisingly found herein, however, that the effective use of nitrite for the acceleration of phosphating at low temperature is in a limited range in that too much nitrite will inhibit the acid attack on the metal to such a degree that no coating can be formed.

In a conventional high temperature phosphating process using nitrite as the accelerator, it is desirable to maintain a nitrite content at all times to prevent the buildup of ferrous iron in solution. Ferrous iron is normally oxidized to ferric iron by the nitrite. Should a ferrous iron condition develop in the presence of nitrite in the high temperature bath, the familiar dark-colored ferrous nitrosyl complex is formed and the solution loses its coating capabilities. The solution becomes very aggressive against the substrate metal and little phosphate coating is formed. Larger quantities of nitrite are required to destroy this complex in order to restore satisfactory bath operation to the high temperature bath. These additions of nitrite are accompanied by the evolution of oxides of nitrogen.

It is generally felt that small amounts of nitrite are generated by the reduction of nitrate normally present in a phosphating solution. At high temperature, this nitrite is quickly dissipated in part as oxides of nitrogen without further reduction and partly by further reduction resulting ultimately in the generation of ammonia.

It has been surprisingly discovered herein that, at low temperatures, i.e., 70° F., ferrous iron and nitrite can coexist in solution and that all of the nitrite is not converted to the ferrous nitrosyl complex. The conventional method of analysis for nitrite or ferrous iron, i.e., permanganate titration, is not reliable for the control of the low temperature bath herein because it cannot discriminate between the two. A colorimetric method based on the addition of excess ferrous iron is reliable for the control of nitrite. In use, the low temperature solution of the present invention may develop the dark ferrous nitrosyl color but, surprisingly, this does not interfere with the solution's ability to form a quality coating nor does it result in excessive attack on the metal substrate. It has been found herein that the amount of nitrite must be controlled between specific limits by the periodic addition of nitrite.

The quantity of nitrite necessary to provide the advantages of the present invention may vary. However, it has been found that concentrations below 0.13 grams per liter of working solution, as $NO_2^-$, result in incomplete coatings on the metal surface. On the other hand, nitrite concentrations above about 0.33 grams per liter of working solution have been found to result in powdery coatings.

While the use of nitrite to accelerate the coating action of a phosphate solution at high temperature is well known, its use at low temperature will not, of and by itself, convert a high temperature bath into an effective low temperature bath. In order to provide an effective formulation, the ratios of calcium to zinc must be substantially different from those generally disclosed in the prior art, such as, for instance, in the examples provided in U.S. Pat. No. 3,090,709.

Thus, in order to accomplish the objects of the present invention, the calcium to zinc mole ratio should be between 2.8 to 1 and 5.0 to 1, and most preferably 3.5 to 1 in conjunction with an appropriate phosphate to nitrate ratio. A lower molar ratio of calcium to zinc has been found to produce voids in the coating. Moreover, the phosphate to nitrate molar ratio for the purposes of this invention should be from 0.18 to 2.8 to 1, and most preferably 0.43 to 1. The minimum metal molarity, that is, the sum of the zinc and calcium concentrations, should be at least about 0.2 molar, preferably about 0.45 molar, and the ratio of the total acid to free acid is from about 8 to 1 to 40 to 1 and preferably about 12 to 1. The drawing herein graphically shows the concentrations of ingredients used herein and the effects on the coatings when concentrations outside those used herein are employed.

The phosphating solutions of the present invention can be prepared by the usual methods from raw materials that are easily obtainable and utilizing mixing equipment normally used for the production of conventional phosphating solutions. The techniques for the manufacture of phosphating concentrates are well known to the art and no special procedures are required to produce industrial strength concentrates suitable for use in this invention. It may be desired to supply the liquid concentrates, one containing the zinc and phosphate and the other containing the calcium and nitrate, or it may be desired to combine the metals and their anions in the form of a single concentrate.

The ingredients of the microcrystalline zinc phosphate compositions of the present invention may be derived from a variety of compounds, including salts and acids. Typically, the phosphating solutions of the present invention can be conveniently made by dissolving zinc oxide and phosphoric acid in water to supply the required zinc and phosphate ions. By adjusting the amount of phosphoric acid, the acidity of the solution (i.e., points total acid) is also controlled. Calcium nitrate is added to provide the necessary calcium and nitrate ions.

Alternatively, the phosphating solution of the present invention can be made by dissolving zinc dihydrogen phosphate in water to supply the required zinc and phosphate ions. Calcium nitrate is added to provide the calcium and nitrate ions. The acidity of the solution can be adjusted by the addition of small amounts of phosphoric or nitric acid.

Another way to provide the necessary ingredients of the coating baths of this invention is to dissolve zinc nitrate in water and then add a phosphate of calcium. Phosphoric acid or nitric acid can be used to adjust the acidity in this instance, too. Calcium carbonate can also be employed herein as a source of calcium ion.

Thus, zinc coating materials useful in the practice of the present invention include zinc oxide, zinc carbonate, zinc hydroxide, elemental zinc, zinc nitrate and zinc phosphate. Calcium containing materials used herein include calcium carbonate, calcium hydroxide, calcium oxide, calcium nitrate and calcium phosphate. Acids contemplated herein are typically phosphoric, nitric, the alkali metal salts thereof, and mixtures thereof.

In order to provide additional attack on the substrate metal, soluble metal ions may also be incorporated into the coating compositions of the present invention. These metal ions include those metals whose potential lies between iron and hydrogen in the electromotive series. Typically, these metals include nickel, cobalt, lead, cadmium, indium, molybdenum, and tin. A preferred metal for this purpose is nickel and it can be introduced into the formulation by any convenient manner such as the nitrate or carbonate. Nickel nitrate, such as nickel nitrate hexahydrate, is a particularly preferred source of nickel. The concentration of these metal materials used herein generally ranges from about 0.03 molar to about 0.2 molar, with 0.07 molar being preferred.

The nitrite which must be present in the working baths of the present invention may also be provided by any convenient source. This is usually accomplished by the use of sodium nitrite or potassium nitrite and may be supplied to the user in a dry form for dissolving prior to addition to the working solution or may be supplied in the form of a prepared liquid concentrate. Sodium nitrite is preferred.

In order to convert the dissolved zinc and calcium into phosphate coating, the entire system should be held at a balance of ratio between total and free acid so that the solution is essentially saturated with phosphating material at the operating temperature and free acid level. Typically, the working solution should be adjusted to provide about 60.0 points of total acid and 5.0 points of free acid, i.e., a ratio of total to free acid of about 12 to 1, based on a 10 milliliter sample titrated with 0.1 N sodium hydroxide.

The phosphate coating compositions of the present invention may be applied to the metal surface, such as steel or zinc coated surfaces, like zinc coated steel, by any conventional and accepted manner. Typically, for best results, the metal surface is first cleaned by physical and/or chemical means to remove grease, dirt, and oxides. The cleaned article is then rinsed with water and treated with the phosphating coating composition. The coating method may be any technique commonly used, such as spraying, brushing, dipping, or roller-coating.

In contrast to the coating compositions of the prior art which typically must be applied at temperatures in the order of 160° F. to 200° F. in order to obtain satisfactory coatings, the coating compositions of this invention can be applied to the metal substrate at temperatures in the range of from about 70° F. to 120° F., and preferably at about 100° F. In spray applications, temperatures in the range of from about 80° F. to about 120° F. are suitable.

The coating weight will vary with the processing time and may be as little as 25 mg. per square foot of surface area but is generally from about 50–700 and typically about 300 mgs. per square foot. Processing times may vary from about one minute to thirty minutes. In spray applications, processing times of 30 seconds to about 15 minutes are preferred.

Because of the high concentration of calcium utilized herein, the calcium is very susceptible to precipitation as the fluoride. Therefore, it is important that the formulations of the present invention be essentially free of fluoride either in its simple or complex form.

In order that those skilled in the art may better understand how to practice the present invention, the following examples are given by way of illustration and not by way of limitation.

EXAMPLE 1

Two concentrates are prepared in accordance with the following formulations:

| | |
|---|---|
| Concentrate A: | |
| Zinc Oxide | 162.8 g/l (2.0 M) |
| Phosphoric Acid, 85% | 691.8 g/l (6.0 M) |
| Nickel Nitrate Hexahydrate | 20 g/l (0.07 M) |
| Water | 599.4 g/l |
| Concentrate B: | |
| *Calcium Nitrate | 928 g/l (4.55 M) |
| Water | 612 g/l |

*Calcium nitrate assayed at 80.4% by weight.

A working solution is prepared by combining Concentrate A and Concentrate B and additional water in such a manner as to produce a 5% solution of Concentrate A and a 7.7% solution of Concentrate B by volume. The free acid of this solution is 10.3 points and the total acid is 67.5 points. Pointage is the number of milliliters of 0.1 N sodium hydroxide required to neutralize 10 ml sample to the methyl orange endpoint for a measure of the free acid and to the phenolphthalein endpoint for the measure of the total acid. An addition of sodium hydroxide solution is made to the working solution to reduce the free acid to 5.0 points and the total acid to 63.6 points. The mole ratio of calcium to zinc is 3.5 to 1 and the mole ratio of phosphate to nitrate is 0.43 to 1. Sodium nitrite is added to the solution in sufficient quantity so as to provide a 0.5 g/l concentration. The solution is heated to 100° F. and a clean, weighed 2 × 3" 1010 steel panel is immersed for 15 minutes. The panel is then rinsed, dried, and reweighed. The coating is then removed in a solution of 5% chromic acid at 165° F. for 5 minutes. The panel is again rinsed, dried, and weighed. The stock loss is considered to be the difference in weight between the original and stripped weight and amounts to 717.6 milligrams per square foot. The coating weight is measured by the difference between the coated weight and the stripped weight and amounts to 370.8 milligrams per square foot. This is equivalent to a conversion ratio of 0.52 (coating weight divided by stock loss). This may be considered to be the efficiency of conversion of the bath.

Comparative Example 1A

For comparison purposes a conventional high temperature calcium modified zinc phosphate concentrate is prepared in accordance with the following formulations:

| | |
|---|---|
| Concentrate C: | |
| Zinc Oxide | 130 g/l (1.6 M) |
| Phosphoric Acid, 75% | 467 g/l (3.6 M) |
| Nitric Acid, 42° Be | 135 g/l (1.5 M) |
| *Calcium Nitrate | 290 g/l (1.4 M) |
| Water | 498 g/l |
| Concentrate D: | |
| *Calcium Nitrate | 928 g/l (4.55 M) |
| Water | 612 g/l |

*Calcium nitrate assayed at 80.4% by weight.

A working solution is prepared by combining Concentrate C and Concentrate D and additional water in such a manner as to provide a 4% solution of Concentrate C and a 2% solution of Concentrate D by volume. This solution shows a free acid of 6.3 points and a total acid of 34.5 points. The mole ratio of calcium to zinc is 1.4 to 1 and the mole ratio of phosphate to nitrate is 0.4 to 1. An addition of sodium hydroxide is used to reduce the free acid to 5.5 points and the total acid to 33.3 points. The solution is heated to 170° F. and a 2 × 3" weighed steel panel is processed as described above. The stock loss is 513.6 milligrams per square foot and the coating weight is 285.6 milligrams per square foot, giving a conversion ratio of 0.56.

It is seen, therefore, that the low temperature coating composition of the present invention (Example 1) produces a greater stock loss and a greater coating weight while keeping the efficiency of conversion relatively the same. The quality of the coatings produced in both formulations is fully comparable with respect to appearance, microcrystallinity, and uniformity of coverage.

EXAMPLE 2

A working solution is prepared in the following manner:

To a beaker containing 3.7 g of zinc oxide and approximately 200 ml of water, is added 11.5 g of phosphoric acid, 85% and 36.5 g of nitric acid, 42° Be. To the resulting solution is added 18.0 g of calcium carbonate. The above mixture is then diluted to 500 ml with water. To the above solution is added 0.5 g of nickel nitrate hexahydrate and 0.25 g. of sodium nitrite. The solution shows a free acid of 11.7 points. An addition of 2.3 ml of aqua ammonia reduces the free acid to 5.1 points and the total acid to 43.2 points. The solution is heated to 100° F. and a weighed 2 × 3" steel panel is processed as described above. The stock loss is 625 milligrams per square foot, and the coating weight is 268 milligrams per square foot giving a conversion ratio of 0.4. The quality of the coating produced with the above formulation is acceptable with respect to appearance, microcrystallinity, and uniformity of coverage. The ratio of calcium to zinc of the coating composition of this example is 4.0 to 1, and the ratio of phosphate to nitrate is 0.25 to 1.

EXAMPLE 3

A working solution is prepared in the following manner:

To a beaker containing 3.7 g of zinc oxide and approximately 200 ml of water, is added 19.2 g of phosphoric acid, 85% and 30.5 g of nitric acid, 42° Be. To the resulting solution is added 18.0 g of calcium carbonate. The above mixture is then diluted to 500 ml with water. To the above solution is added 0.5 g of nickel nitrate hexahydrate and 0.25 g. of sodium nitrite. The solution showed a free acid of 11.4 points. An addition of 2.6 ml of aqua ammonia reduces the free acid to 4.9 points and the total acid to 62.9 points. The solution is heated to 100° F. and a weighed 2 × 3" steel panel is processed as described above. The stock loss is 576 milligrams per square foot, and the coating weight is 449 milligrams per square foot giving a conversion ratio of 0.8. The quality of the coating produced with the above formulation is acceptable with respect to appearance, microcrystallinity, and uniformity of coverage. The ratio of calcium to zinc used in the Example is 4.0 to 1, and the ratio of phosphate to nitrate is 0.5 to 1.

EXAMPLE 4

A working solution was prepared in the following manner:

To a beaker containing 3.7 g of zinc oxide and approximately 200 ml of water, is added 28.8 g of phosphoric acid, 85% and 22.8 g of nitric acid, 42° Be. To the resulting solution is added 18.0 g of calcium carbonate. The above mixture is then diluted to 500 ml with water. To the above solution is added 0.5 g of nickel nitrate hexahydrate and 0.25 g. of sodium nitrite. The solution shows a free acid of 10.6 points. An addition of 2.2 ml of aqua ammonia reduces the free acid to 5.0 points and the total acid to 76.8 points. The solution is heated to 100° F. and a weighed 2 × 3" steel panel is processed as described above. The stock loss is 552 milligrams per square foot, and the coating weight is 652 milligrams per square foot giving a conversion ratio of 1.2. The quality of the coating produced with the above formulation is acceptable with respect to appearance, microcrystallinity, and uniformity of coverage. The ratio of calcium to zinc used in the Example is 4.0 to 1, and the ratio of phosphate to nitrate is 1.0 to 1.

EXAMPLE 5

A working solution is prepared in the following manner:

To a beaker containing 3.7 g of zinc oxide and approximately 200 ml of water, is added 38.5 g of phosphoric acid, 85% and 15.2 g of nitric acid, 42° Be. To the resulting solution is added 18.0 g of calcium carbonate. The above mixture is then diluted to 500 ml with water. To the above solution is added 0.5 g of nickel nitrate hexahydrate and 0.25 g. of sodium nitrite. The solution shows a free acid of 10.1 points. An addition of 2.0 ml of aqua ammonia reduces the free acid to 5.1 points and the total acid to 90.8 points. The solution is heated to 100° F. and a weighed 2 × 3" steel panel is processed as described above. The stock loss is 490 milligrams per square foot, and the coating weight is 740 milligrams per square foot giving a conversion ratio of 1.5. The quality of the coating produced with the above formulation is acceptable with respect to appearance, microcrystallinity, and uniformity of coverage. The ratio of calcium to zinc used in the Example is 4.0 to 1, and the ratio of phosphate to nitrate is 2.0 to 1.

EXAMPLE 6

A working solution is prepared in the following manner:

To a beaker containing 4.8 g of zinc oxide and approximately 200 ml of water, is added 8.7 g of phosphoric acid, 85% and 38.8 g of nitric acid, 42° Be. To the resulting solution is added 16.6 g of calcium carbonate. The above mixture is then diluted to 500 ml with water. The ratio of calcium to zinc in the above solution is 2.8 to 1, and the ratio of phosphate to nitrate is 0.18 to 1. To the above solution is added 0.5 g of nickel nitrate hexahydrate and 0.25 g of sodium nitrite. This solution shows a free acid of 11.9 points. An addition of 2.1 ml of aqua ammonia reduces the free acid to 5.2 points and the total acid to 38.3 points. The solution is heated to 100° F. and a weighed 2 × 3" steel panel is processed as described above. The stock loss is 617 milligrams per square foot, and the coating weight is 269 milligrams per square foot giving a conversion ratio of 0.4.

The coating produced in this Example is of marginal quality due to incomplete coverage.

EXAMPLE 7

A working solution is prepared in the following manner:

To a beaker containing 4.8 g of zinc oxide and approximately 200 ml of water, is added 42.7 g of phosphoric acid, 85% and 11.9 g of nitric acid, 42° Be. To the resulting solution is added 16.6 g of calcium carbonate. The above mixture is then diluted to 500 ml with water. The ratio of calcium to zinc in the above solution is 2.8 to 1, and the ratio of phosphate to nitrate is 2.8 to 1. To the above solution is added 0.5 g of nickel nitrate hexahydrate and 0.25 g. of sodium nitrite. This solution shows a free acid of 11.3 points. An addition of 2.1 ml of aqua ammonia reduces the free acid to 5.2 points and the total acid to 103.7 points. The solution is heated to 100° F. and a weighed 2 × 3" steel panel is processed as described above. The stock loss is 307 milligrams per square foot, and the coating weight is 776 milligrams per square foot giving a conversion ratio of 2.5.

The coating produced in Example 7 is of marginal quality with respect to coarseness and crystal structures.

EXAMPLE 8

A working solution is prepared in the following manner:

To a beaker containing 2.8 g of zinc oxide and approximately 200 ml of water, is added 8.7 g of phosphoric acid, 85% and 38.8 g of nitric acid, 42° Be. To the resulting solution is added 19.1 g of calcium carbonate. The above mixture is then diluted to 500 ml with water. The ratio of calcium to zinc in the above solution is 5.6 to 1 and the ratio of phosphate to nitrate is 0.18 to 1. To the above solution is added 0.5 g of nickel nitrate hexahydrate and 0.25 g. of sodium nitrite. This solution shows a free acid of 11.9 points. An addition of 2.2 ml of aqua ammonia reduces the free acid to 5.0 points and the total acid to 36.0 points. The solution is heated to 100° F. and a weighed 2 × 3" steel panel is processed as described above. The stock loss is 713 milligrams per square foot, and the coating weight is 266 milligrams per square foot, giving a conversion ratio of 0.4.

The coating produced in Example 8 is of marginal quality due to incomplete coverage.

EXAMPLE 9

A working solution is prepared in the following manner:

To a beaker containing 2.8 g of zinc oxide and approximately 200 ml of water, is added 42.7 g of phosphoric acid, 85% and 11.9 g of nitric acid, 42° Be. To the resulting solution is added 19.1 g of calcium carbonate. The above mixture is then diluted to 500 ml with water. The ratio of calcium to zinc in the above solution is 5.6 to 1, and the ratio of phosphate to nitrate is 2.8 to 1. To the above solution is added 0.5 g of nickel nitrate hexhydrate and 0.25 g of sodium nitrite. This solution shows a free acid of 11.2 points. An addition of 2.2 ml of aqua ammonia reduces the free acid to 4.9 points and the total acid to 100.0 points. The solution is heated to 100° F. and a weighed 2 × 3" steel panel was processed as described above. The stock loss is 474 milligrams per square foot, and the coating weight is 760 milligrams per square foot giving a conversion ratio of 1.6.

The coating produced in Example 9 is of marginal quality with respect to uniformity of coverage.

EXAMPLE 10

A working solution is prepared in the same manner as described in Example 1. The solution is heated to 100° F. and a weighed minimum spangle, hot dipped galvanized panel is immersed for 15 minutes. The coating is removed in an ammonium dichromate-ammonium hydroxide solution. The coating weight is 2142.0 milligrams per square foot, and the stock loss is 639.6 milligrams per square foot. This is equivalent to a conversion ratio of 3.3. The coating produced is fine, crystalline. The crystal size is about 40 microns in diameter.

A heavy spangle, hot dipped galvanized panel is treated in the same manner as described above. The coating weight is 1734.0 milligrams per square foot and the stock loss is 632.4 milligrams per square foot. The coating produced is coarse and crystalline. The crystal size is about 80 to about 120 microns in diameter.

EXAMPLE 11

A spray bath is prepared by combining concentrate A and Concentrate B, described in Example 1, and water in such a manner as to produce a 2.5% solution of Concentrate A and a 3.85% solution of Concentrate B by volume. Sodium hydroxide is added to the bath to yield a free acid of 0.8 points and a total acid of 28.6 points. Sodium nitrite is added to the solution in sufficient quantity so as to provide a 0.5 g/l concentration. This solution is operated at about 100° F. A 4" × 6" steel panel is cleaned by immersion in a 60 gram per liter aqueous solution of the following composition:

| | |
|---|---|
| Sodium Carbonate | 61.5% by weight |
| Disodium Phosphate | 32.5 |
| Petro AG Special (alkyl naphthalene sodium sulfonate), Petrochemicals, Inc. | 3.0 |
| Igepal Co-630 (nonylphenoxypoly-(ethyleneoxy) ethanol), GAF, Corp. | 2.0 |
| Lakeway 301-10 (alpha-olefin sulfonate) Lakeway Chemicals Corp. | 1.0 |

The panel is then sprayed for 5 minutes at 15 psi. The panel is then rinsed and dried. The stock loss is 348 milligrams per square foot, and the coating weight is 393.6 milligrams per square foot. The quality of the coating produced is good with respect to appearance, microcrystallinity, and uniformity of coverage.

EXAMPLE 12

In order to assess the energy saving characteristic of the 100° F. process of the present invention, the volume of steam condensate is collected for a period of two hours when the solution, as described in Example 1, is maintained at a fixed temperature in a 40-gallon stainless steel tank having top surface dimensions of 15 inches by 24 inches. At 100° F. the condensate collection rate is 850 milliliters per hour. At 160° F. the rate is 3100 milliliters per hour, and at 180° F. the rate is 4950 milliliters per hour. Thus the heat losses at 160° F. are 3.6 times as great as 100° F., and the loss at 180° F. is 5.8 times as great as 100° F.

Obviously, other modifications and variations of the present invention are possible in the light of the above teachings. It is, therefore, to be understood that changes may be made in the particular embodiments of the invention described which are within the full intended scope of the invention as defined by the appended claims.

What is claimed and desired to be secured by Letters Patent is:

1. A microcrystalline zinc phosphate aqueous coating composition useful at low temperatures, said composition comprising calcium ion, zinc ion, phosphate ion, nitrate ion and nitrite ion wherein the sum of the total calcium and zinc concentration is at least about 0.2 molar, the calcium to zinc molar ratio is from about 2.8 to 1 to about 5.8 to 1, the total phosphate to nitrate molar ratio is from about 0.18 to 1 to about 2.8 to 1, nitrite concentration, as $NO_2^-$, is from about 0.13 to about 0.33 grams per liter of coating composition and the ratio of total acid to free acid is from about 8 to 1 to about 40 to 1.

2. An aqueous coating composition as defined in claim 1 wherein the ratio of total acid to free acid is 12 to 1.

3. An aqueous coating composition as defined in claim 2 wherein the total calcium to zinc molar ratio is about 3.5 to 1, the total phosphate to nitrate molar ratio is about 0.43 to 1, the nitrite concentration, as $NO_2^-$, is about 0.23 grams per liter and the total acid to free acid ratio is about 12 to 1.

4. An aqueous coating composition as defined in claim 3 which further includes a soluble metal ion selected from those metals whose potential lies between iron and hydrogen in the electromotive series.

5. An aqueous coating composition as defined in claim 4 wherein said soluble metal ion is selected from the group consisting of nickel, cobalt, lead, cadmium, indium, molybdenum and tin.

6. An aqueous coating composition as defined in claim 5 wherein said soluble metal ion is nickel.

7. An aqueous coating composition as defined in claim 3 which is substantially free of fluoride.

8. An aqueous coating composition as defined in claim 2 which further includes a soluble metal ion selected from those metals whose potential lies between iron and hydrogen in the electromotive series.

9. An aqueous coating composition as defined in claim 8 wherein said soluble metal ion is selected from the group consisting of nickel, cobalt, lead, cadmium, indium, molybdenum and tin.

10. An aqueous coating composition as defined in claim 9 wherein said soluble metal ion is nickel.

11. An aqueous coating composition as defined in claim 2 which is substantially free of fluoride.

12. An aqueous coating composition as defined in claim 1 which is substantially free of fluoride.

13. An aqueous coating composition as defined in claim 1 which further includes a soluble metal ion selected from those metals whose potential lies between iron and hydrogen in the electromotive series.

14. An aqueous coating composition as defined in claim 13 wherein said soluble metal ion is selected from the group consisting of nickel, cobalt, lead, cadmium, indium, molybdenum and tin.

15. An aqueous coating composition as defined in claim 14 wherein said soluble metal ion is nickel.

16. A microcrystalline zinc phosphate aqueous coating composition useful at low temperatures, said composition comprising calcium ion, zinc ion, phosphate ion, nitrate ion, nitrite ion and nickel ion, wherein the sum of the total calcium and zinc concentration is about 0.45 molar, the total calcium to zinc molar ratio is about 3.5 to 1, the total phosphate to nitrate molar ratio is about 0.43 to 1, nitrite concentration, as $NO_2^-$, is about 0.23 grams per liter of coating composition, the ratio of total acid to free acid is about 12 to 1 and wherein the composition is substantially free of fluoride.

17. A process for providing a phosphate coating to a metal substrate at low temperatures, said process comprising applying to said metal substrate a microcrystalline zinc phosphate aqueous coating composition at a temperature from about 70° F. to about 120° F., said coating composition comprising calcium ion, zinc ion, phosphate ion, nitrate ion and nitrite ion wherein the sum of the total calcium and zinc concentration is at least about 0.2 molar, the total calcium to zinc molar ratio is from about 2.8 to 1 to about 5.8 to 1, the total phosphate to nitrate molar ratio is from about 0.18 to 1 to about 2.8 to 1, nitrite concentration, as $NO_2^-$, is about 0.13 to 0.33 grams per liter of coating composition and the ratio of total acid to free acid is from about 8 to 1 to about 40 to 1.

18. A process as defined in claim 17 wherein said aqueous coating composition is substantially free of fluoride.

19. A process as defined in claim 17 wherein said aqueous coating composition further includes a soluble metal ion selected from those metals whose potential lies between iron and hydrogen in the electromotive series.

20. A process as defined in claim 19 wherein said soluble metal ion is selected from the group consisting of nickel, cobalt, lead, cadmium, indium, molybdenum and tin.

21. A process as defined in claim 20 wherein said soluble metal ion is nickel.

22. A process as defined in claim 17 wherein the calcium to zinc molar ratio is about 3.5 to 1, the phosphate to nitrate molar ratio is about 0.43 to 1, nitrite concentration, as $NO_2^-$, is about 0.23 grams per liter of said aqueous coating composition and wherein the ratio of total acid to free acid is about 12 to 1.

23. A process as defined in claim 22 wherein said aqueous coating composition is substantially free of fluoride and further includes a soluble metal ion selected from those metals whose potential lies between iron and hydrogen in the electromotive series.

24. A process as defined in claim 23 wherein said soluble metal ion is selected from the group consisting of nickel, cobalt, lead, cadmium, indium, molybdenum and tin.

25. A process as defined in claim 24 wherein said soluble metal ion is nickel.

26. A process as defined in claim 22 wherein said aqueous coating composition is applied to said metal substrate at about 100° F.

27. A process as defined in claim 22 wherein said metal substrate is selected from the group consisting of steel and zinc coated surfaces.

28. A process as defined in claim 22 wherein said aqueous coating composition is applied to said metal substrate at about 100° F. and said metal substrate is selected from the group consisting of steel and zinc coated surfaces.

29. A process as defined in claim 17 wherein said aqueous coating composition is applied to said metal substrate at about 100° F.

30. A process as defined in claim 17 wherein said metal substrate is selected from the group consisting of steel and zinc coated surfaces.

31. A process as defined in claim 17 wherein said aqueous coating composition is applied to said metal substrate at about 100° F. and said metal substrate is selected from the group consisting of steel and zinc coated surfaces.

32. A process as defined in claim 17 wherein the ratio of total acid to free acid is about 12 to 1.

33. A process as defined in claim 32 wherein said aqueous coating composition further includes a soluble metal ion selected from those metals whose potential lies between iron and hydrogen in the electromotive series.

34. A process as defined in claim 33 wherein said aqueous coating composition is substantially free of fluoride.

35. A process as defined in claim 34 wherein said soluble metal ion is selected from the group consisting of nickel, cobalt, lead, cadmium, indiom, molybdenum and tin.

36. A process as defined in claim 35 wherein said soluble metal ion is nickel.

37. A process as defined in claim 17 wherein the phosphate coating is applied by immersing said metal substrate in said aqueous coating composition.

38. A process as defined in claim 17 wherein the phosphate coating is applied by spraying said aqueous coating composition onto said metal substrate at a temperature of from about 80° F. to about 120° F.

39. A process for providing a phosphate coating to a metal substrate at low temperatures, said process comprising applying to a metal substrate selected from the group consisting of steel and zinc coated surfaces a microcrystalline zinc phosphate aqueous coating composition at a temperature of about 100° F., said coating composition comprising calcium ion, zinc ion, phosphate ion, nitrate ion, nitrite ion and nickel ion, wherein the sum of the total calcium and zinc concentration is about 0.45 molar, the total calcium to zinc molar ratio is about 3.5 to 1, the total phosphate to nitrate molar ratio is about 0.43 to 1, nitrite concentration, as $NO_2^-$, is about 0.23 grams per liter of coating composition, the ratio of total acid to free acid is about 12 to 1 and wherein the composition is substantially free of fluoride.

40. A process for preparing a microcrystalline zinc phosphate aqueous coating composition, useful at low temperatures, said process comprising the steps of (a) admixing
  (i) a concentrate comprising water, zinc ions and phosphate ions with
  (ii) a concentrate comprising water, calcium ions and nitrate ions;
(b) admixing an additional quantity of water therewith; and
(c) admixing therewith a source of nitrite ions, wherein the total calcium to zinc molar ratio in the resultant coating compositon is from about 2.8 to 1 to about 5.8 to 1, the total phosphate is nitrate molar ratio in the resultant coating composition is from about 0.18 to 1 to about 2.8 to 1, the nitrite concentration, as $NO_2^-$, is about 0.13 to about 0.33 grams per liter of coating composition and the ratio of total acid to free acid is about 8 to 1 to about 40 to 1.

41. A process as defined in claim 40 wherein the concentrate (i) also contains a soluble metal ion selected from those metals whose potential lies between iron and hydrogen in the electromotive series.

42. A process as defined in claim 41 wherein said soluble metal ion is selected from the group consisting of nickel, cobalt, lead, cadmium, indium, molybdenum and tin.

43. A process as defined in claim 40 wherein the total calcium to zinc molar ratio in the resultant composition is about 3.5 to 1, the total phosphate to nitrate molar ratio in the resultant coating composition is about 0.43 to 1, the nitrite concentration, as $NO_2^-$, is about 0.23 grams per liter, and the total acid to free acid ratio is about 12 to 1.

44. A process as defined in claim 40 wherein concentrate (i) is derived from the admixture of water, zinc oxide, and phosphoric acid, concentrate (ii) is derived from water and calcium nitrate and said source of nitrite is sodium nitrite.

45. A process as defined in claim 44 wherein concentrate (i) further contains nickel ions.

46. A process for preparing a microcrystalline zinc phosphate aqueous coating composition useful at low temperatures, said process comprising the steps of (a) admixing
  (i) A concentrate comprising
    water,
    zinc ions at a concentration of 2.0 molar
    and phosphate ions at a concentration of 6.0 molar with (ii) a concentrate comprising
    water,
    calcium ions at a concentration of 4.55 molar and nitrate ions at a concentration of 9.1 molar;
(b) admixing an additional quantity of water therewith to obtain a minimum metal molarity of 0.2; and
(c) admixing therewith a source of nitrite ions, wherein the total calcium to zinc ratio in the resultant coating composition is about 3.5 to 1, the total phosphate to nitrate molar ratio in the resulting coating composition is about 0.43 to 1, the nitrite concentration, as $NO_2^-$, is about 0.23 grams per liter of coating composition and the ratio of total acid to free acid is about 12 to 1.

47. A process for preparing a microcrystalline zinc phosphate aqueous coating composition as defined in claim 46, wherein the concentrate (i) also contains a soluble metal selected from those metals whose potential lies between iron and hydrogen in the electromotive series.

48. A process for preparing a microcrystalline zinc phosphate aqueous coating composition as defined in claim 46, wherein the concentrate (i) also contains a soluble metal ion selected from the group consisting of nickel, cobalt, lead, cadmium, indium, molybdenum, and tin.

49. A process for preparing a microcrystalline zinc phosphate aqueous coating composition as defined in claim 46, wherein the concentrate (i) also contains nickel nitrate at a concentration of about 0.07 molarity.

50. A process for preparing a microcrystalline zinc phosphate aqueous coating composition, useful at low temperatures, said process comprising admixing water, a zinc containing material selected from the group consisting of zinc oxide, zinc carbonate, zinc hydroxide, elemental zinc, zinc nitrate, zinc phosphate, a calcium containing material selected from the group consisting of calcium carbonate, calcium hydroxide, calcium oxide, calcium nitrate and calcium phosphate, and an acid selected from the group consisting of nitric, phosphoric, the alkali metal salts thereof, and mixtures thereof, and a nitrite, wherein the amounts of said water, zinc containing material, calcium containing material and acid are sufficient to provide a total calcium and zinc concentration of at least about 0.2 molar, a total calcium to zinc molar ratio of from about 2.8 to 1 to about 5.8 to 1, a total phosphate to nitrate molar ratio of from about 0.18 to 1 to about 2.8 to 1. a nitrite concentration, as $NO_2^-$, of from about 0.13 to about 0.33 grams per liter, and the ratio of total acid to free acid is from about 8 to 1 to about 40 to 1.

51. A process as defined in claim 50 wherein said ratio of total acid to free acid is about 12 to 1.

52. A process as defined in claim 50 wherein the total calcium and zinc concentration is about 0.45 molar.

53. A process as defined in claim 50 wherein the total calcium to zinc molar ratio is about 3.5 to 1, the total phosphate to nitrate molar ratio is about 0.43 to 1, the nitrite concentration, as $NO_2^-$, is about 0.23 grams per liter, and the total acid to free acid ratio is about 12 to 1.

54. A process as defined in claim 50 wherein said zinc containing material is zinc oxide, said calcium containing material is calcium nitrate and said acid is phosphoric acid.

55. A process as defined in claim 50 wherein said zinc containing material is zinc oxide, said calcium containing material is calcium carbonate and said acid is a mixture of nitric acid and phosphoric acid.

56. A process as defined in claim 50 wherein said zinc containing material is zinc oxide, said calcium containing material is calcium nitrate, said acid is phosphoric acid, said total calcium and zinc concentration is about 0.45 molar, said total calcium to zinc molar ratio is about 3.5 to 1, said total phosphate to nitrate molar ratio is about 0.43 to 1, said nitrite concentration, as $NO_2^-$, is about 0.23 gram per liter and the ratio of total acid to free acid is about 12 to 1.

57. A process as defined in claim 56 which further includes admixing nickel nitrate hexahydrate.

58. A process as defined in claim 50 which further includes admixing a source of soluble metal ion, said metal selected from the group consisting of those metals whose potential lies between iron and hydrogen in the electromotive series.

59. The microcrystalline zinc phosphate coating resulting from the process defined in claim 17.

60. The microcrystalline zinc phosphate coating resulting from the process defined in claim 18.

61. The microcrystalline zinc phosphate coating resulting from the process defined in claim 19.

62. The microcrystalline zinc phosphate coating resulting from the process defined in claim 20.

63. The microcrystalline zinc phosphate coating resulting from the process defined in claim 21.

64. The microcrystalline zinc phosphate coating resulting from the process defined in claim 22.

65. The microcrystalline zinc phosphate coating resulting from the process defined in claim 23.

66. The microcrystalline zinc phosphate coating resulting from the process defined in claim 24.

67. The microcrystalline zinc phosphate coating resulting from the process defined in claim 25.

68. The microcrystalline zinc phosphate coating resulting from the process defined in claim 26.

69. The microcrystalline zinc phosphate coating resulting from the process defined in claim 27.

70. The microcrystalline zinc phosphate coating resulting from the process defined in claim 28.

71. The microcrystalline zinc phosphate coating resulting from the process defined in claim 29.

72. The microcrystalline zinc phosphate coating resulting from the process defined in claim 30.

73. The microcrystalline zinc phosphate coating resulting from the process defined in claim 31.

74. The microcrystalline zinc phosphate coating resulting from the process defined in claim 32.

75. The microcrystalline zinc phosphate coating resulting from the process defined in claim 33.

76. The microcrystalline zinc phosphate coating resulting from the process defined in claim 34.

77. The microcrystalline zinc phosphate coating resulting from the process defined in claim 35.

78. The microcrystalline zinc phosphate coating resulting from the process defined in claim 36.

79. The microcrystalline zinc phosphate coating resulting from the process defined in claim 37.

80. The microcrystalline zinc phosphate coating resulting from the process defined in claim 38.

81. The microcrystalline zinc phosphate coating resulting from the process defined in claim 39.

* * * * *